US006126260A

United States Patent [19]

Lan et al.

[11] Patent Number: 6,126,260

[45] Date of Patent: Oct. 3, 2000

[54] METHOD OF PROLONGING LIFETIME OF THERMAL BUBBLE INKJET PRINT HEAD

[75] Inventors: Yuan-Liang Lan; Ming-Ling Lee, both of Hsinchu Hsien; Yi-Yung Wu, Taichung Hsien; Chu-Wen Chen; Ten-Hsing Jaw, both of Hsinchu, all of Taiwan

[73] Assignee: Industrial Technology Research Institute, Hsinchu, Taiwan

[21] Appl. No.: 09/086,094

[22] Filed: May 28, 1998

[51] Int. Cl.[7] ..... B41J 29/38

[52] U.S. Cl. ..... 347/11

[58] Field of Search ..... 347/10, 11, 55

[56] References Cited

U.S. PATENT DOCUMENTS

| | | | |
|---|---|---|---|
| 4,104,646 | 8/1978 | Fischbeck | 347/11 |
| 4,424,520 | 1/1984 | Matsuda et al. | 347/11 |
| 4,523,201 | 6/1985 | Liker | 347/11 |
| 4,716,418 | 12/1987 | Heinzl et al. | 347/11 |
| 4,746,937 | 5/1988 | Realis Luc et al. | 347/11 |
| 4,972,211 | 11/1990 | Aoki | 347/11 |
| 5,204,695 | 4/1993 | Tokunaga et al. | 347/11 |
| 5,305,024 | 4/1994 | Moriguchi et al. | 347/11 |
| 5,736,994 | 4/1998 | Takahashi | 347/11 |
| 5,880,750 | 3/1999 | Takahashi | 347/10 |
| 5,903,286 | 5/1999 | Takahashi | 347/11 |

FOREIGN PATENT DOCUMENTS

| | | | |
|---|---|---|---|
| 1-130949 | 5/1989 | Japan | 347/10 |

*Primary Examiner*—William J. Royer
*Attorney, Agent, or Firm*—Knobbe, Martens, Olsen & Bear, LLP

[57] ABSTRACT

A method of prolonging the lifetime of a thermal-bubble-ink-jet print head. A first pulse is provided to a heater of the print head for generating a first bubble to expel an ink drop. A second pulse is provided to the heater after a delay time for generating a second bubble is generated. The second pulse is not large enough to expel another ink drop.

6 Claims, 6 Drawing Sheets

METHOD OF PROLONGING LIFETIME OF THERMAL BUBBLE INKJET PRINT HEAD

BACKGROUND OF THE INVENTION

1. Field of the Invention

The invention relates to a method of prolonging the lifetime of a thermal bubble inkjet print head, and more particularly to a method of obtaining an available set of parameters for prolonging the lifetime of a thermal bubble inkjet print head by means of investigating the effects of various parameters.

2. Description of the Related Art

In present technologies, all commercial thermal-bubble-ink-jet printers employ a single energy pulse applied to a heater in a print head to generate a bubble on a heated surface of the heater. Thus, an ink drop is expelled onto a piece of paper by the heat driven bubble.

In FIG. 3, a time-dependent bubble volume by applying a single pulse to a conventional printer, for example, HP500 printers, is shown. It is seen that as applying a single pulse with a pulse voltage (PV) of about 18V and pulse width (PW) of about 3 $\mu$s to a print head, for example, HP51626, a bubble starts to be generated at about 2 $\mu$s. More specifically, when the pulse voltage is applied for the first two micro-seconds, some small bubbles are generated randomly and locally on the heater surface. The small bubble is then coalesced into a single bubble afterwards. This single bubble reaches a maximum value of volume at about 7 $\mu$s to 8 $\mu$s. The bubble vanishes away at about 16 $\mu$s to 20 $\mu$s.

In FIG. 2, a PV-PW critical curve for a single pulse bubble generation is shown. When PV is taken as 18V, PW has to be wider than 1.0 $\mu$s to generate a bubble.

Once the single energy pulse is turned off, this heat driven bubble starts to collapse. The bubble shrinks from a maximum value of volume to vanish. During a very short time while the bubble is collapsing, an extremely high pressure is caused to damage the heater severely. Consequently, the lifetime of the print head is shortened.

SUMMARY OF THE INVENTION

It is therefore an object of the invention to provide a method of prolonging the lifetime of a thermal-bubble-ink-jet print head. Double pulses are applied to a heater of a thermal-bubble-ink-jet print head during a drop ejection cycle. The first pulse is to generate a bubble to expel a drop of ink onto a piece of paper. The second pulse is to generate a smaller and a longer lasting bubble than the first one. The second bubble is regarded as a buffer to absorb a part of the damage force caused while the first bubble is collapsing. Therefore, the effect of heater damage due to the pressure wave bombardments generated from sequential bubble collapses is softened.

To achieve these objects and advantages, and in accordance with the purpose of the invention, as embodied and broadly described herein, the invention is directed towards a method of prolonging the lifetime of a thermal-bubble-ink-jet print head. A first pulse is provided to a heater of the print head for generating a first bubble to expel an ink drop. A second pulse is provided to the heater after a delay time for generating a second bubble. The second pulse is not large enough to expel another ink drop.

It is to be understood that both the foregoing general description and the following detailed description are exemplary and explanatory only and are not restrictive of the invention, as claimed.

DESCRIPTION OF THE PREFERRED EMBODIMENTS

In a preferred embodiment according to the invention, in a thermal-bubble-ink-jet printers, double pulses are applied during a drop ejection cycle. The first pulse, similar to the single pulse generation, is used to generate a bubble to expel a drop of ink onto a piece of paper. The second pulse is used to generate a smaller and longer lasting bubble compared to the first one before the first one vanishes. The second bubble is regarded as a buffer since it absorbs a part of the damage force resulting from the collapse of the first bubble. There are five parameters, the first pulse voltage PV1 and pulse width PW1, the second pulse voltage PV2 and pulse width PW2, and a time delay, to define the double pulses. Taguchi method is used to investigate the effects of these parameters.

Figure 1:
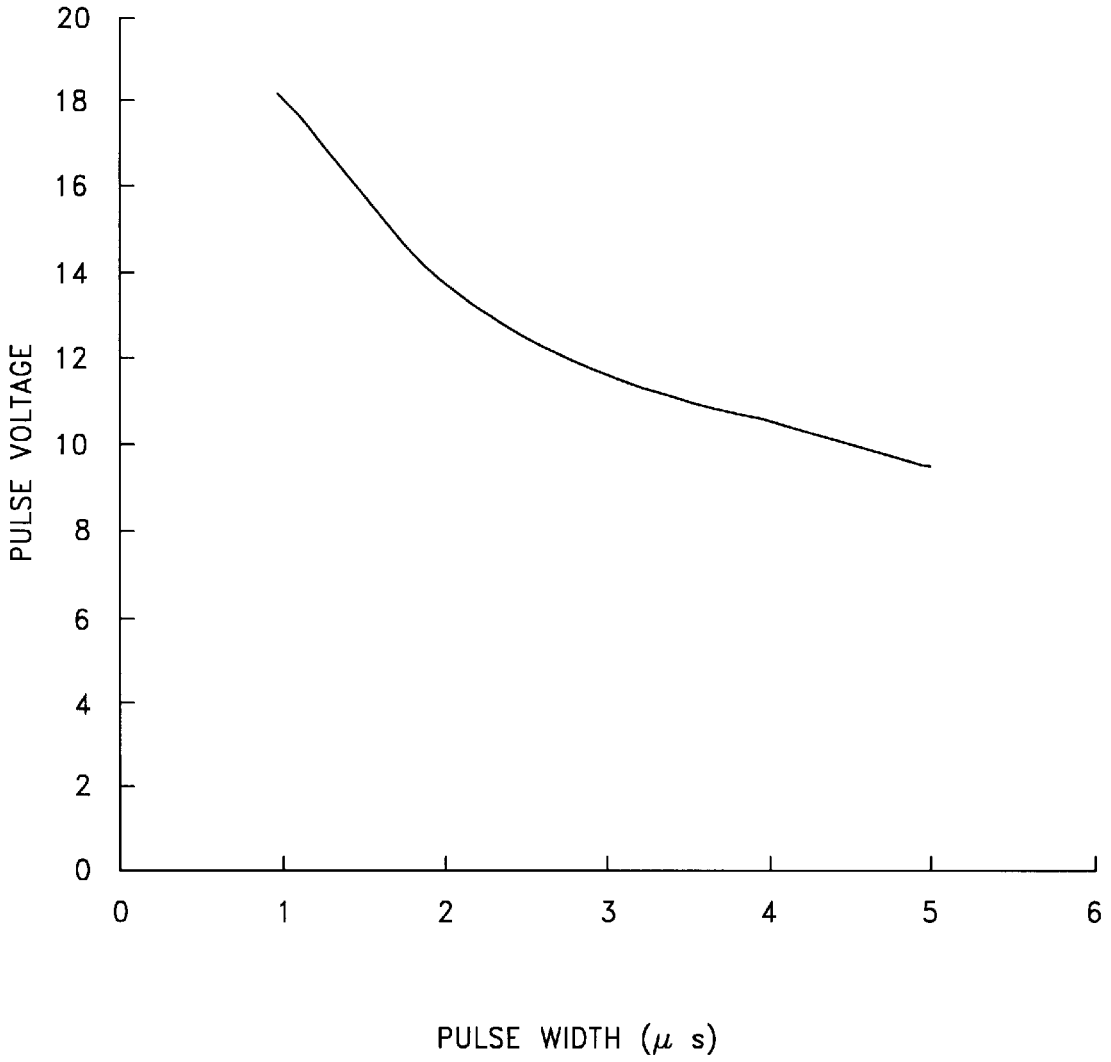
FIG. 1 (PRIOR ART)
FIG. 1 shows a PV-PW curve for a double pulse generation.

As mentioned above, the first pulse is to generate a bubble to expel a drop of ink, so that according to FIG. 1, for a pulse voltage of about 18V, a pulse width has to be wider than 1 $\mu$s. However, considering the double pulse case, since both first pulse and second pulse applied to the heater supply energy thereto, it is expected that the first pulse does not provide too much heat energy to the heater. Therefore, when the first pulse voltage PV1 is about 18V, the first pulse width PW1 is no less than 1.0 $\mu$s and no wider than 3.0 $\mu$s, that is: $1.0\ \mu s \leqq PW1 \leqq 3.0\ \mu s$.

Figure 2:
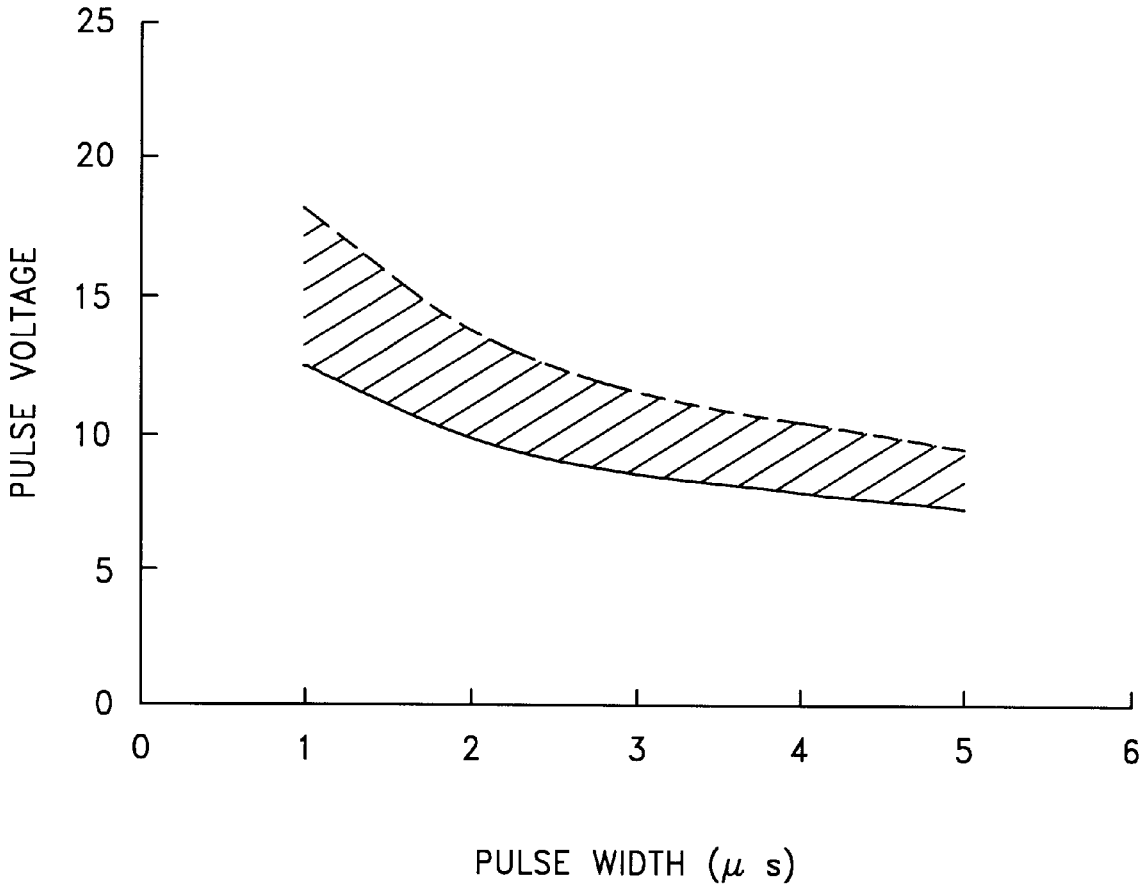
FIG. 2 shows a PV-PW critical core for a single pulse bubble generation.

The second pulse is regarded as a buffer to absorb a part of the damage force resulting from the collapse of the first bubble without degrading the printing quality. Therefore, the second bubble generated by the second pulse has to be smaller than the first bubble generated by the first pulse. Moreover, the second bubble cannot expel a drop of ink out of the nozzle. In FIG. 2, the solid line represents a PV-PW critical curve for generating a bubble. The dash line represents a PV-PW critical curve for forming an ink drop. Therefore, the hatched region represents an applicable region of values for PV2 and PW2.

Figure 3:
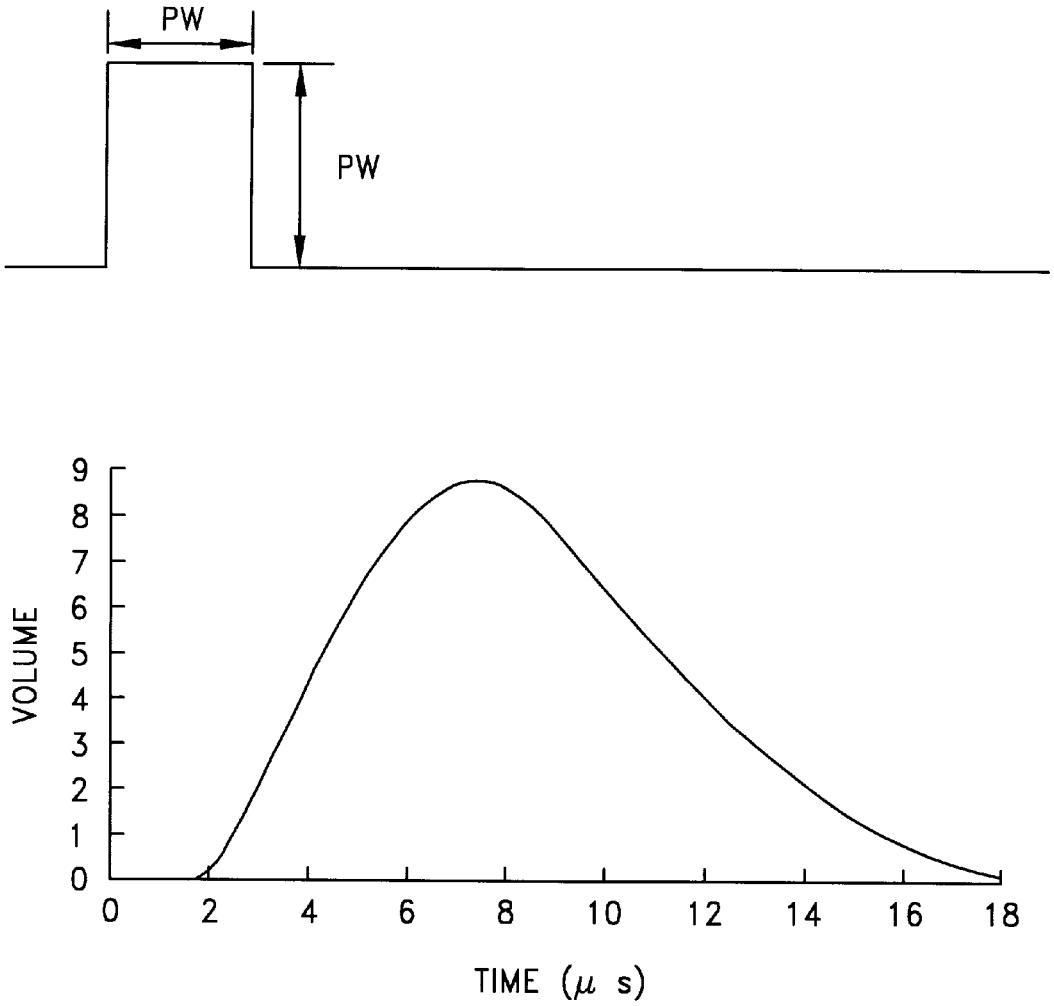
FIG. 3 (PRIOR ART)
FIG. 3 shows time-dependent bubble volume by applying a single pulse to a conventional printer.
Figure 4:
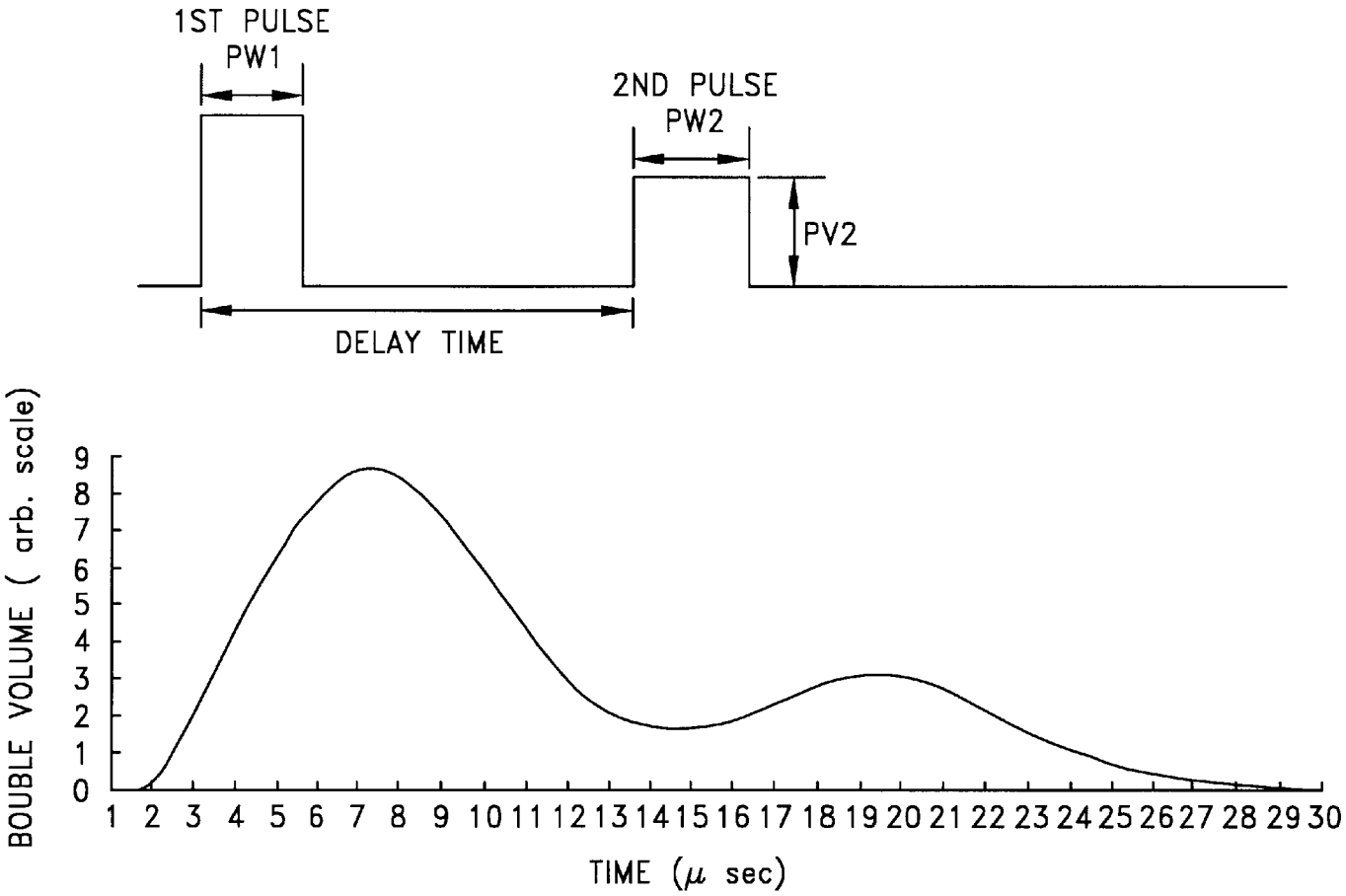
FIG. 4 shows time-dependent bubble volume by applying a double pulse according to the invention.

The time-dependent volume of a single pulse generation is shown as FIG. 3. When the surface of a heater is covered by the first bubble entirely, a very thin air layer exists between the heater surface and ink. The air layer is regarded as an adiabatic layer due to a very low heat conductivity of air. Therefore, the heat energy cannot be transferred into ink from the heater. The temperature of the heater rises quickly. An obvious thermal stress is applied to the heater consequently. On the other hand, while the first bubble vanishes completely, a transient high pressure caused by the collapse of the first bubble is applied to the heater. Therefore, a delay time between the formation of the first bubble and the second bubble is the time duration before the first bubble starts to vanish, that is, while a part of ink starts to contact with the heater surface, and after the first bubble vanishes completely. The time-dependent volume of a double pulse bubble generation is shown as FIG. 4. It is to be noted that when the second pulse is applied before the temperature of the heater surface drops down to room temperature, the values of PW2 and PV2 of the applied second pulse have to be adjusted corresponding to the temperature of the heater surface.

Taguchi method is used to optimize five parameters (PV1, PW1, PV2, PW2, and Delay time). Two kinds of testing samples are used. One is HP51626A print heads for close pool testing, the other is HP51626A print heads without a nozzle plate for open pool testing. With the help of microscope and CCD camera, the entire bubble growth and the failure mode of the heater can be observed from a monitor. The print head without a nozzle plate has to be headstand and the chip is upward. A drop of deionized water is dripped onto the surface of the chip. At the same time, a counter is used to count the number of firing cycles. The final count of firing cycle is considered to be the index of lifetime. Comparing these two testing methods, the lifetime of open pool testing is shorter than the lifetime of close pool testing. This is because that the center is close pool testing of the extremely high pressure caused during the collapse of the bubble is closer than that in open pool testing.

Table 1 shows the experimental condition of the double pulses case for a set of experiment of the open pool test, and Table 2 shows the experiment condition of the double pulses case for a set of experiment of the close pool test.

TABLE 1

PV1 = 18V

| Factor | Level (1) | (2) | (3) |
|---|---|---|---|
| A. PW1 (μs) | 2 | 2.5 | 3 |
| B. PV2 (V) | 8 | 11 | 14 |
| C. PW2 (μs) | 2 | 3 | 4 |
| D. Delay Time (μs) | 9 | 13 | 18 |

| Experiment Number | Parameters of double pulse 1. PW1 (A) | 2. PV2 (B) | 3. PW2 (C) | 4. Delay Time (D) |
|---|---|---|---|---|
| 1 | 1(2.0μs) | 1(8V) | 1(2.0μs) | 1(9.0μs) |
| 2 | 1(2.0μs) | 2(11V) | 2(3.0μs) | 2(13.0μs) |
| 3 | 1(2.0μs) | 3(14V) | 3(4.0μs) | 3(18.0μs) |
| 4 | 2(2.5μs) | 1(8V) | 2(3.0μs) | 3(18.0μs) |
| 5 | 2(2.5μs) | 2(11V) | 3(4.0μs) | 1(9.0μs) |
| 6 | 2(2.5μs) | 3(14V) | 1(2.0μs) | 2(13.0μs) |
| 7 | 3(3.0μs) | 1(8V) | 3(4.0μs) | 2(13.0μs) |
| 8 | 3(3.0μs) | 2(11V) | 1(2.0μs) | 3(18.0μs) |
| 9 | 3(3.0μs) | 3(14V) | 2(3.0μs) | 1(9.0μs) |

TABLE 2

PV1 = 18V

| Factor | Level (1) | (2) | (3) |
|---|---|---|---|
| A. PW1 (μs) | 2 | 2.5 | 3 |
| B. PV2 (V) | 8 | 11 | 14 |

TABLE 2-continued

PV1 = 18V

| | | | |
|---|---|---|---|
| C. PW2 (μs) | 2 | 3 | 4 |
| D. Delay Time (μs) | 9 | 12 | 16 |

| Experiment Number | Parameters of double pulse 1. PW1 (A) | 2. PV2 (B) | 3. PW2 (C) | 4 Delay Time (D) |
|---|---|---|---|---|
| 1 | 1(2.0μs) | 1(8V) | 1(2.0μs) | 1(9.0μs) |
| 2 | 1(2.0μs) | 2(11V) | 2(3.0μs) | 2(12.0μs) |
| 3 | 1(2.0μs) | 3(14V) | 3(4.0μs) | 3(16.0μs) |
| 4 | 2(2.5μs) | 1(8V) | 2(3.0μs) | 3(16.0μs) |
| 5 | 2(2.5μs) | 2(11V) | 3(4.0μs) | 1(9.0μs) |
| 6 | 2(2.5μs) | 3(14V) | 1(2.0μs) | 2(12.0μs) |
| 7 | 3(3.0μs) | 1(8V) | 3(4.0μs) | 2(12.0μs) |
| 8 | 3(3.0μs) | 2(11V) | 1(2.0μs) | 3(16.0μs) |
| 9 | 3(3.0μs) | 3(14V) | 2(3.0μs) | 1(9.0μs) |

Table 3 shows the results for the open pool test according to the parameters given in Table 1, and Table 4 shows the results of close pool testing according to the parameters given in Table 2. While applying a single pulse with PV=18V and PW=3 μs to an HP51626 print head, an ink drop with a diameter of approximately 60.5 μm is obtained with a ink drop speed of about 11 m/sec. The lifetime for the open pool test is about $2.6\times10^8$ firing cycles, and the lifetime for the close pool test is about $3.4\times10^8$ firing cycles. In the above two conditions of the single pulse generation, it is apparent that the lifetime of the bubble generated by a single pulse is longer than the lifetime of the bubble generated by a double pulse except a set of data. Therefore, it is critical to choose a set of optimized parameters of the double pulses to prolong the lifetime of an ink-jet print head.

TABLE 3

| Experimental Number | Lifetime ($R_i$) | $\eta_i$ (S/N) |
|---|---|---|
| 1 | $1.0 \times 10^8$ | −80.00 |
| 2 | $1.2 \times 10^8$ | −80.61 |
| 3 | $3.4 \times 10^8$ | −85.30 |
| 4 | $1.9 \times 10^8$ | −72.99 |
| 5 | $5.8 \times 10^8$ | −77.63 |
| 6 | $7.5 \times 10^8$ | −78.75 |
| 7 | $2.0 \times 10^8$ | −73.01 |
| 8 | $6.0 \times 10^8$ | −67.78 |
| 9 | $2.2 \times 10^8$ | −73.42 |

TABLE 4

| Experimental Number | Lifetime ($R_i$) | $\eta_i$ (S/N) |
|---|---|---|
| 1 | $3.43 \times 10^8$ | −85.35 |
| 2 | $3.18 \times 10^8$ | −85.02 |
| 3 | $4.75 \times 10^8$ | −86.77 |
| 4 | $1.50 \times 10^8$ | −81.76 |
| 5 | $2.08 \times 10^8$ | −83.18 |
| 6 | $2.50 \times 10^8$ | −83.98 |
| 7 | $7.41 \times 10^8$ | −78.70 |
| 8 | $1.02 \times 10^8$ | −70.09 |
| 9 | $9.02 \times 10^8$ | −79.55 |

In Table 3 and Table 4, the lifetimes $R_i$ obtained from different sets of parameters are transformed into a S/N ratio, $\eta_i$; $\eta_i=10 \log_{10}R_i$(dB), where i equals to 1 to 9. A 4×3 matrix M with elements $m_{jk}$ (j=A, B, C, D; k=1,2,3) denotes the mean effect of factors. $m_{jk}$ is expressed as:

| | |
|---|---|
| $m_{A1} = \frac{1}{3}(\eta_1 + \eta_2 + \eta_3)$ | $m_{A2} = \frac{1}{3}(\eta_4 + \eta_5 + \eta_6)$ |
| $m_{A3} = \frac{1}{3}(\eta_7 + \eta_8 + \eta_9)$ | $m_{B1} = \frac{1}{3}(\eta_1 + \eta_4 + \eta_7)$ |
| $m_{B2} = \frac{1}{3}(\eta_2 + \eta_5 + \eta_8)$ | $m_{B3} = \frac{1}{3}(\eta_3 + \eta_6 + \eta_9)$ |
| $m_{C1} = \frac{1}{3}(\eta_1 + \eta_6 + \eta_8)$ | $m_{C2} = \frac{1}{3}(\eta_2 + \eta_4 + \eta_9)$ |
| $m_{C3} = \frac{1}{3}(\eta_3 + \eta_5 + \eta_7)$ | $m_{D1} = \frac{1}{3}(\eta_1 + \eta_5 + \eta_9)$ |
| $m_{D2} = \frac{1}{3}(\eta_2 + \eta_6 + \eta_7)$ | $m_{D3} = \frac{1}{3}(\eta_3 + \eta_4 + \eta_8)$ |

Figure 5:
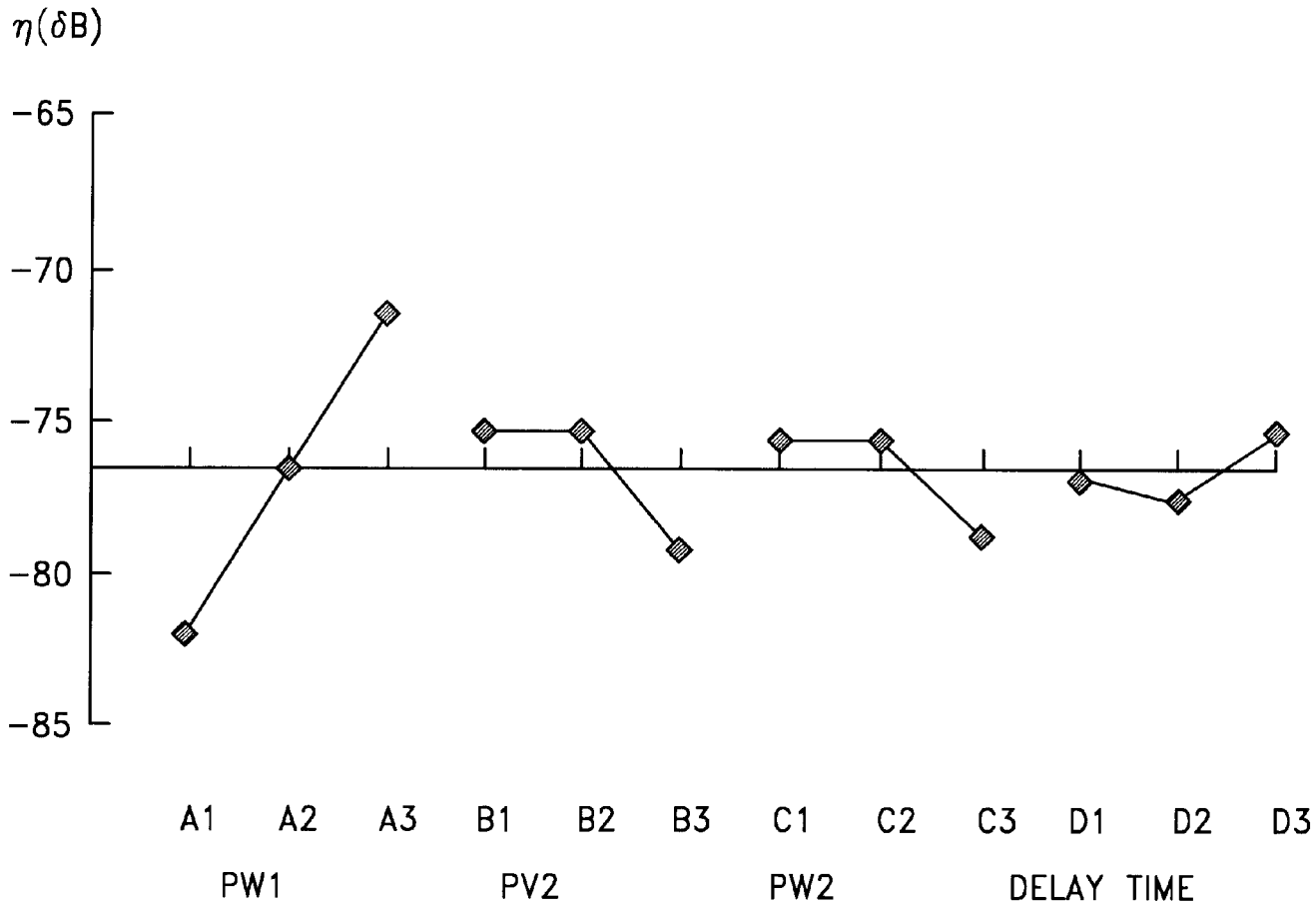
FIG. 5 shows the main effect chart of open pool testing according to the invention.

As shown in FIG. 5, the main effect chart of open pool test, if PW1 is too large, the lifetime of an ink-jet print head is shortened. This is because that the energy of the first pulse is not expected to generate too much heat on the heater. The energy of the first pulse is expected to be just enough to expel a drop of ink. PW2 and PV2 are sufficiently large to generate a second bubble to absorb a part of the damage force caused by the collapse of the first bubble.

Figure 6:
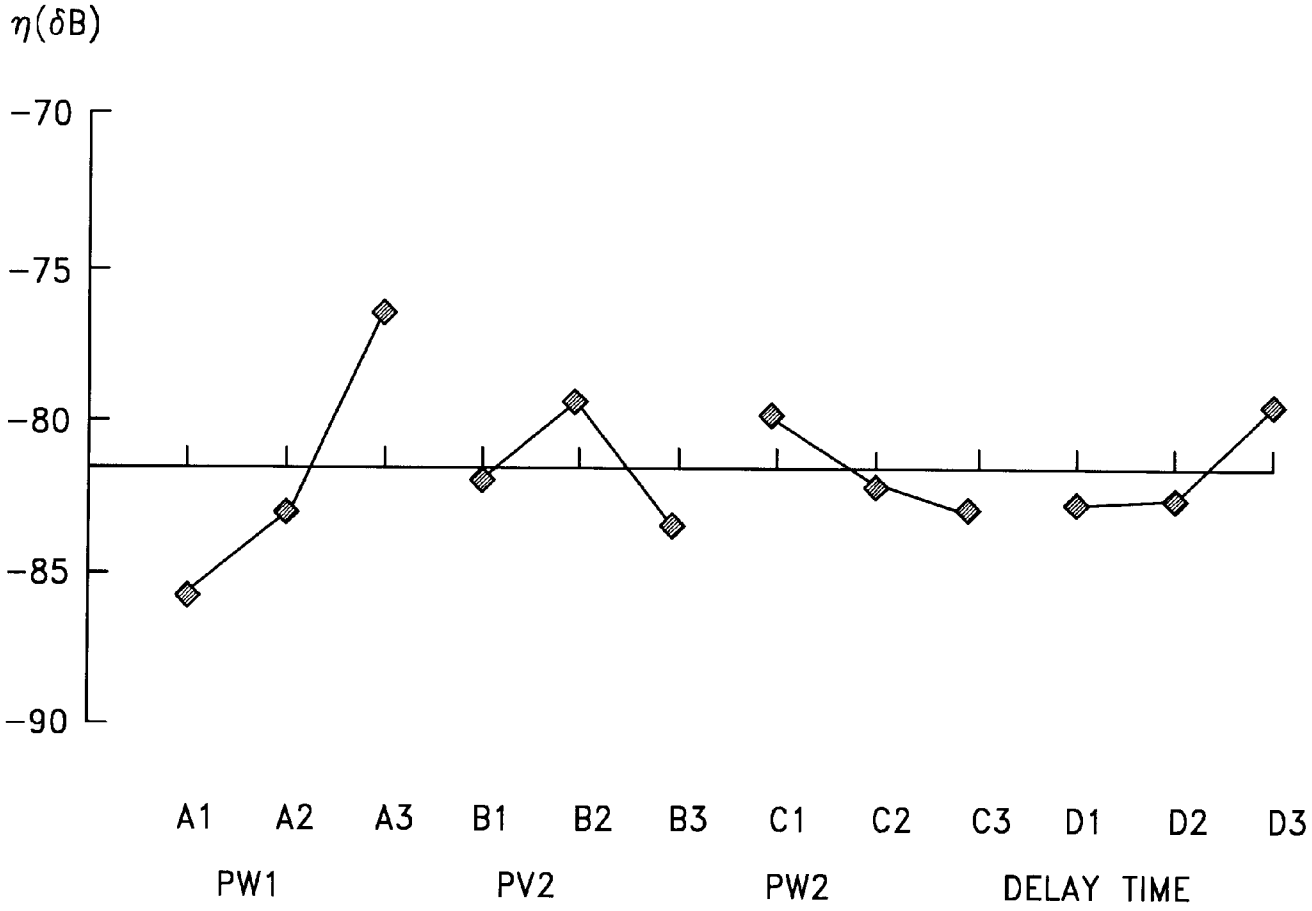
FIG. 6 shows the main effect chart of close pool testing according to the invention.

In FIG. 6, the main effect chart of close pool testing is shown. The result is similar to that shown in FIG. 6. From the above two figures, two optimized parameters for open pool test and close pool test respectively are obtained:

By applying PV1=18V, for the open pool test:

PW1=2 μs, PV2=14V, PW2=4 μs, Delay time=13 μs, a lifetime of $3.4\times10^8$ is obtained; and for close pool testing:

PW1=2 μs, PV2=14V, PW2=4 μs, Delay time=12 μs, a lifetime of $4.8\times10^8$ is obtained.

Thus, by use of Taguchi method to analyze a double pulse bubble generation, a prolonging lifetime of an ink-jet print head is obtained without degrading the printing quality.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A method of prolonging a lifetime of a thermal bubble ink-jet print head using two pulses, the method comprising:

providing a first pulse of the two pulses to a heater of the print head for generating a first bubble to expel an ink drop; and providing a second pulse of the two pulses to the heater after a delay time, for generating a second bubble;

wherein the second pulse does not expel another ink drop, and wherein five parameters of two pulse-heights, two pulse-widths, and the delay time of the two pulses are optimized to prolong the life time of the thermal bubble.

2. The method according to claim 1, wherein the first pulse has a pulse voltage of about 5V to 25V.

3. The method according to claim 2, wherein the first pulse has a pulse width of about 1 μs to 5 μs.

4. The method according to claim 1, wherein the second pulse has a pulse width larger than the first pulse and has a pulse voltage less than the first pulse.

5. The method according to claim 4, wherein the second pulse has a pulse voltage in the range of about one-third to four-fifth of the first pulse.

6. The method according to claim 1, wherein the delay time is about 5 μs to 20 μs.

* * * * *